US007804013B2

(12) United States Patent
Rapaport

(10) Patent No.: US 7,804,013 B2
(45) Date of Patent: Sep. 28, 2010

(54) SNAP AWAY STRINGED MUSICAL INSTRUMENT PICK

(75) Inventor: Neil Rapaport, Chatsworth, CA (US)

(73) Assignee: Pikcard Musical Mfg., Inc., Chatsworth, CA (US)

( * ) Notice: Subject to any disclaimer, the term of this patent is extended or adjusted under 35 U.S.C. 154(b) by 0 days.

(21) Appl. No.: 12/177,959

(22) Filed: Jul. 23, 2008

(65) Prior Publication Data

US 2010/0018379 A1 Jan. 28, 2010

(51) Int. Cl.
*G10D 3/16* (2006.01)

(52) U.S. Cl. ..... 84/320; 273/156

(58) Field of Classification Search ..... 84/320, 84/322; D17/20; D3/204; 273/156
See application file for complete search history.

(56) References Cited

U.S. PATENT DOCUMENTS

| | | | | |
|---|---|---|---|---|
| 3,081,111 | A * | 3/1963 | Kehoe | 462/63 |
| 3,268,136 | A * | 8/1966 | Huffman | 225/2 |
| 7,078,604 | B2 * | 7/2006 | Rapaport | 84/322 |
| 2006/0156895 | A1 * | 7/2006 | Judd et al. | 84/320 |

* cited by examiner

*Primary Examiner*—Jianchun Qin
(74) *Attorney, Agent, or Firm*—Christie, Parker & Hale, LLP

(57) ABSTRACT

Snap away musical instrument picks. A sheet of material is provided that has a plurality of musical instrument picks formed therein by cut lines around the perimeter of the picks except for uncut web areas around each pick. The ends of the cut lines turn into the picks. A pick can be detached from the card body by severing the web to remove a pick when desired, and any rough edges formed by breaking the web are not located along the outer perimeter of the pick. The sheet of material can be sized to be carried in a purse or wallet and the like for easy access.

8 Claims, 4 Drawing Sheets

SNAP AWAY STRINGED MUSICAL INSTRUMENT PICK

BACKGROUND OF THE INVENTION

The invention is in the field of plectrums, or "picks", for stringed musical instruments, and more particularly a die-cut, snap away pick for guitars and other stringed musical instruments that can be easily detached from a card, sheet, strip and the like.

Many stringed instruments such as guitars, mandolins, basses are played with picks, which consist of small generally flat pieces of material that are usually (but not always) flexible. Picks come in many sizes and are made of many kinds of materials including plastics (e.g. PVC, acetal polyoxymethylene (POM) resins (i.e. Delrin®), Nylon, etc), shell, metal, stone, wood, paper, composite materials, and other materials. Picks are manufactured in a variety of thicknesses and stiffnesses, depending on a user's preferences. Picks are often shaped to have one or more rounded points, and can have a generally ogive shape at one or more ends. Picks come in numerous colors and can have graphics appearing thereon. Indeed, picks are collected by musicians and non-musicians alike.

Picks are often displayed at music stores in bulk in plastic bags, in open containers, displayed on paper displays, and the like.

Although picks can last a long time, they are frequently lost or misplaced, and users may wish to use different picks for different songs, instruments and conditions. Lacking a proper pick, a musician can improvise and use another object, such as a coin, as a pick if required. It would be useful for musicians to have a convenient way to carry extra picks so that they are available anytime and any place.

Comfort in use and slip resistance are two additional important factors in choosing picks, and it would therefore be desirable to have picks that are comfortable to hold and which do not have any sharp edges, and also picks which are designed to be firmly gripped without slipping or sliding in the fingers.

It would also be useful to provide a readily accessible supply of picks to musicians during performances that can easily be taken when needed, yet will not be misplaced or lost.

BRIEF DESCRIPTION OF THE DRAWINGS

Further advantages of the invention will become apparent upon a reading of the following detailed description taken in conjunction with the accompanying drawings.

DETAILED DESCRIPTION OF THE INVENTION

Figure 1:
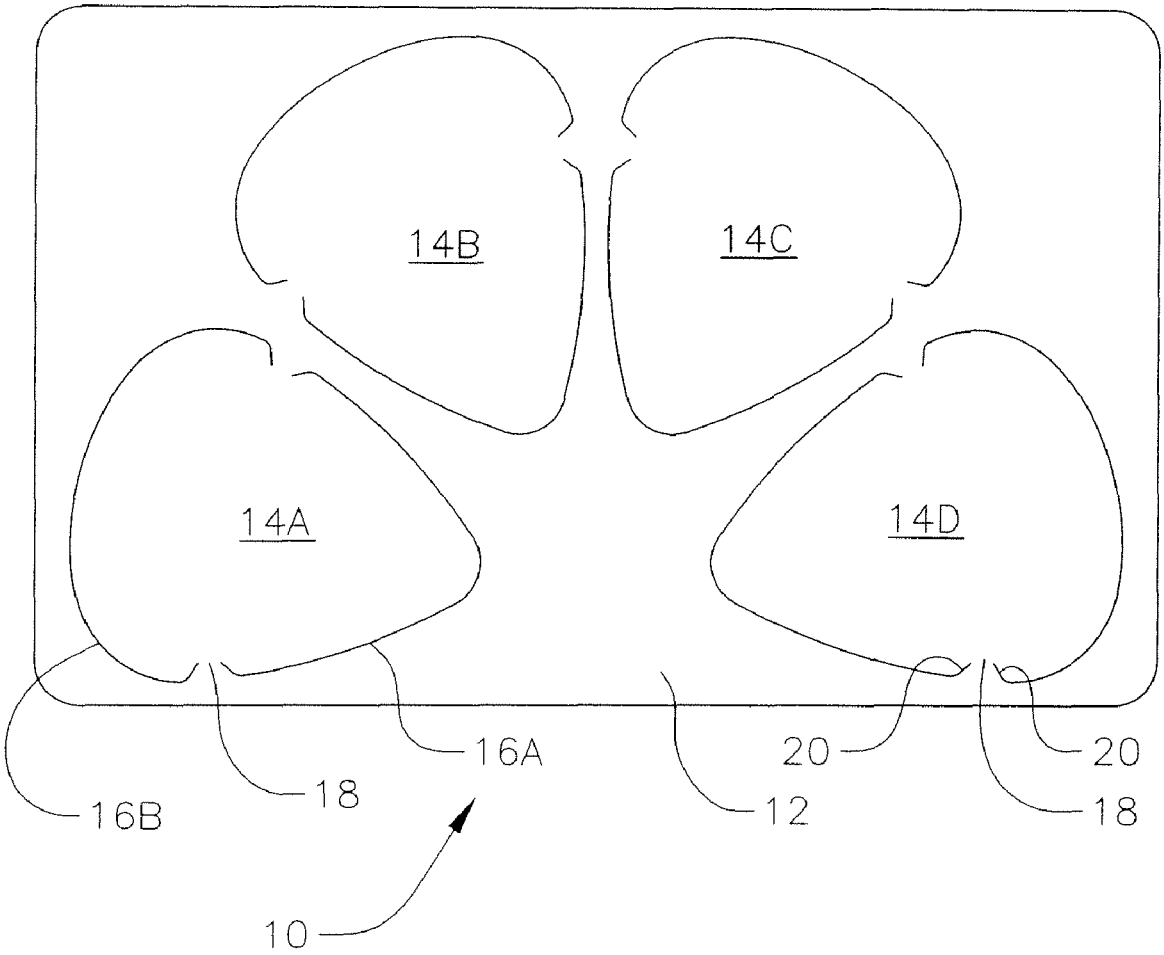
FIG. 1 is a top plan view of a first exemplary embodiment of a wallet-sized card of detachable picks.
Figure 2:
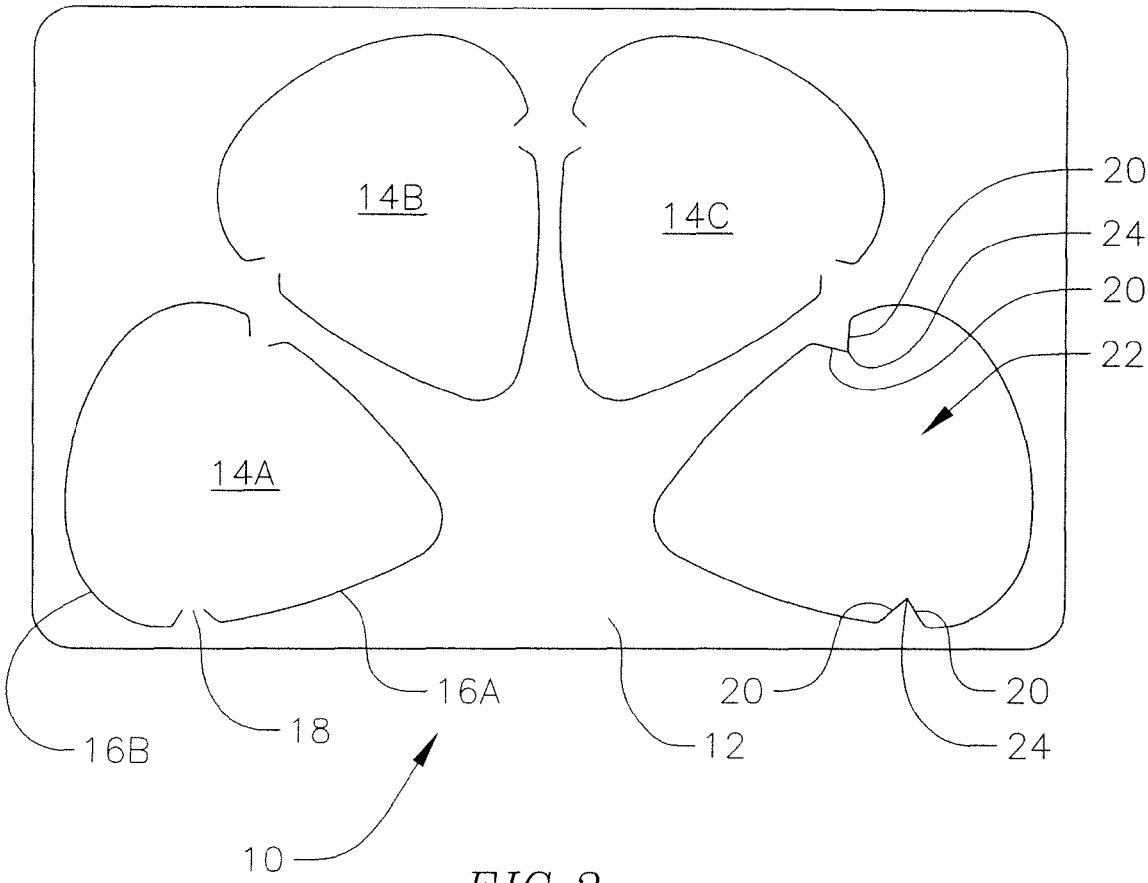
FIG. 2 is a top plan view of the card of FIG. 1 with pick removed.

Referring to FIG. 1, there is shown a top plan view of a first exemplary embodiment of a wallet-sized card 10 of detachable picks and FIG. 2 is a top plan view showing the wallet-sized card 10 of FIG. 1 with pick 14D removed. The card has a card body 12 with four detachable picks 14A, 14B, 14C, and 14D, which are attached to the card body 12 by webs 18 separating cut line sections 16A and 16B. The cut lines 16A and 16B have end sections 20 that turn into the interior of the picks such that the webs 18 are located inwardly of the generally rounded triangular outline of the picks created by the cut lines 16A and 16B. Although four picks are shown, a greater or lesser number of picks can be used. In order to provide a wallet-sized card having standard "business card" dimensions of 85.7 mm×54.0 mm (3.375"×2.125") and picks that are about 31.8 mm to 35 mm (1.25" to 1.375") long, four picks can be accommodated. If larger picks are desired, fewer picks will fit on the card footprint. Also, while the wallet-sized card is convenient to carry, larger sized cards that accommodate more cards can be used. Also, while two cut line sections 16A and 16B are shown, a single cut line can be used, in which case there will be just one web 18.

The card 10 can be made of material such as plastic (e.g., polyvinyl chloride (PVC), acetal polyoxymethylene (POM) resins (i.e. Delrin®.), polycarbonate, Nylon, etc., Teslin® (a synthetic dimensionally stable, highly filled, single layer, microporous film that is polyolefin-based with 60% of its weight comprised of non-abrasive filler and 65% of its volume comprised of air), laminated paper, composite materials, etc., and the like. The picks 14A, 14B, 14C, and 14D can be conveniently die-cut from the card leaving the webs 18 intact so that the picks remain integral with the card until the webs are broken or cut (e.g. by pushing on the pick, twisting the picks relative to the card body 12, or slicing the webs with a blade.) The width and size of the webs 18 can be varied depending on how much force is desired to remove a pick from the card body 12. Although two webs 18 are shown bridging between each pick and the card body 12, a lesser or greater number of webs can be used depending on how secure the picks need to be carried on the card. Depending on the materials used, the card thickness (and thus pick thickness) can be varied to control the stiffness of the pick. Using PVC and Teslin® sheet material, good results have been achieved with 0.51 mm thickness material (0.02" or 20 mil), 0.76 mm thickness material (0.03" or 30 mil), 1.02 mm thickness material (0.04" or 40 mil), and 1.27 mm thickness material (0.05" or 50 mil). Other thicknesses can be used, and these thicknesses apply to all of the embodiments disclosed herein.

Referring again to FIG. 2, it is a top plan view showing the wallet-sized card 10 of FIG. 1 with pick 14D removed, leaving an opening 22 in the card body 12. As can be seen, after pick 14D is removed from the card body 12, the webs 18 will break between the end sections 20 along a bridging cut 24 interior of the general outline of the removed pick.

Figure 3:
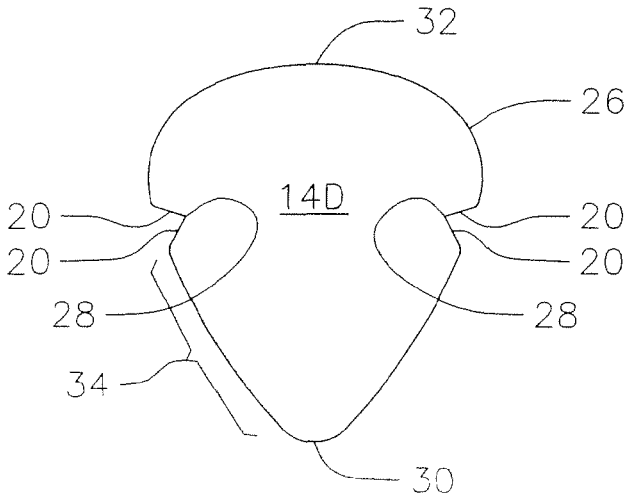
FIG. 3 is a top view of the pick removed from the card of FIG. 2.

FIG. 3 is a top plan view of the snapped off pick 14D. The removed pick 14D has as its outline the cut line sections 16 that defines its wider top 32 which extends down at its left and right sides to the upper ends of the turned in cut lines 20, and its lower half has left and right side 34 and a lower narrower end 30, which is generally used for contact with strings when plucking and picking. As can be seen, the inwardly turn ends 20 of the cut lines generally extend into the body of the pick 14D, and the areas where the webs 18 are broken 28 lie inwardly of the general outline of the side edges 34 of the pick. So, if there are any sharp edges or projections that might have resulted when the picks were removed from the card body, they will lie inwardly of the general outward edges of the pick, and any such sharp edges or projects would not be in contact to cause discomfort with the user's fingers or create a projection which might inadvertently rasp on a musical instrument string. The result is a pick that is comfortable to hold and use and which is smooth at all possible contact surfaces.

The cut lines are made to be relatively thin, so that even after a pick, e.g., 14D is removed from the card body 12, the pick 14D can be reinserted in the opening 22 with the tight fit of the pick 14D forming an interference fit with the opening, thereby allowing reinsertion of the pick and storage therein.

Figure 4:
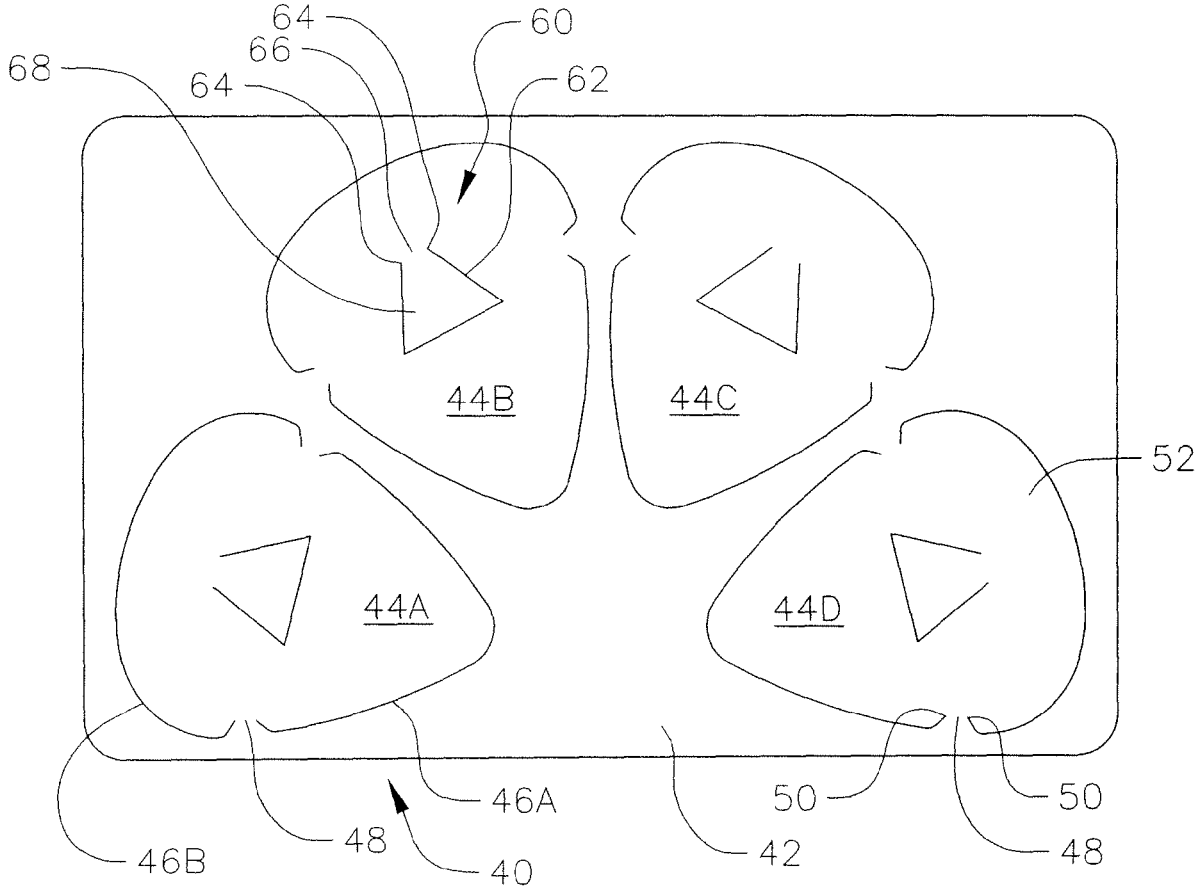
FIG. 4 is a top plan view of a second exemplary embodiment of a wallet-sized card of detachable picks.

FIG. 4 is a top plan view of a second exemplary embodiment of a wallet-sized card 40 of detachable picks that is very similar to the embodiment of wallet-sized card 10 of FIG. 1. Picks 44A, 44B, and 44C are integral with a card body 42, and each pick is connected to the card body 42 by two webs 48 which are uncut areas between the inwardly angled ends 50 of cut lines 46A and 46B. Wile a total of four picks 44A, 44B, and 44C are shown, a greater or lesser number of picks can be arranged on a card body, as discussed with reference to FIGS. 1 and 2. Also, while two cut line sections 46A and 46B are shown, a single cut line can be used, in which case there will be just one web 48. The material and construction of this card can be as described with the card of FIGS. 1 and 2. Each pick, in addition, preferably includes an inwardly located grip 60. The grip 60 is formed by a cut line 62 which can define, for example, a generally triangular cut line through the pick with two terminated spaced apart ends 64, leaving an uncut gap region 66. The cut line 62 can follow other contours and can form other shapes as desired. Due to the flexibility of the material used to form the pick, the grip can pivot slightly on its uncut gap region 66. The cut lines 62 create a discontinuity in the surface of the pick, which discontinuing provides a gripping area for the user's fingers to help the pick avoid slipping when in use.

Figure 5:
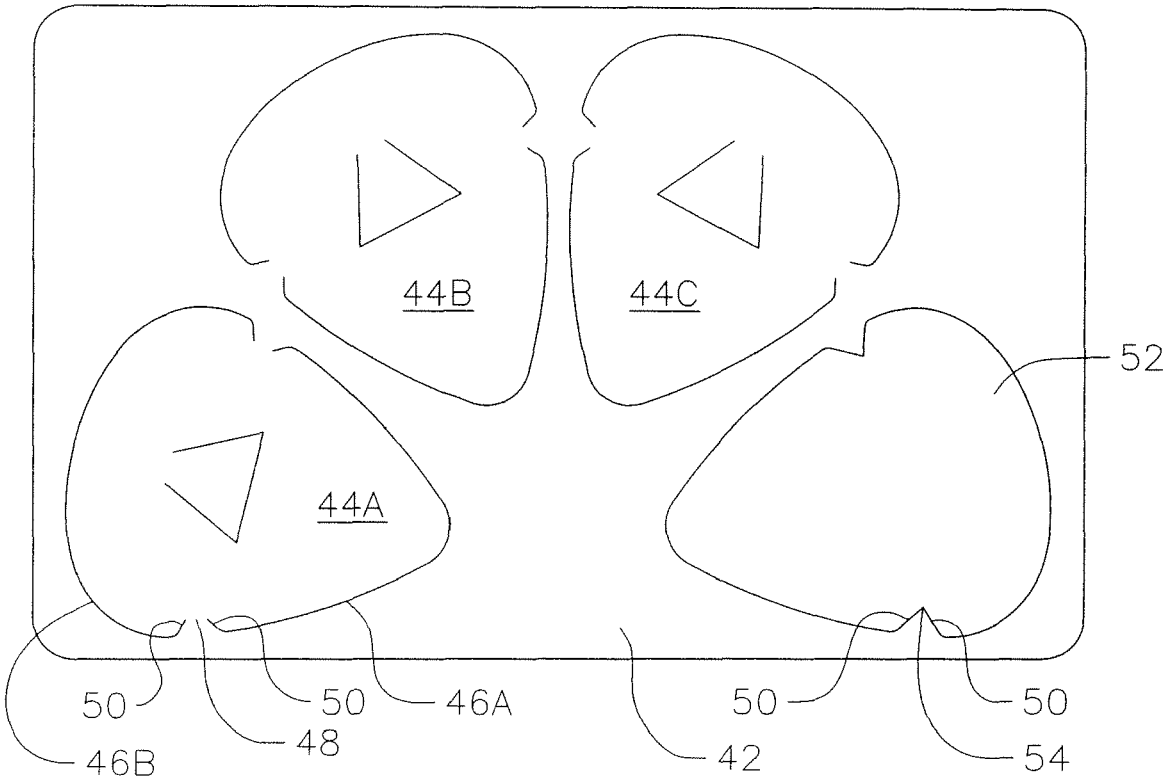
FIG. 5 is a top plan view of the card of FIG. 4 with one piece removed.

FIG. 5 is a top plan view showing the wallet-sized card 40 of FIG. 4 with pick 44D removed, leaving an opening 52 in the card body 42. As can be seen, after pick 44D is removed from the card body 42, the webs 48 will break between the end sections 50 along a bridging cut 54 interior of the general outline of the removed pick.

Figure 6:
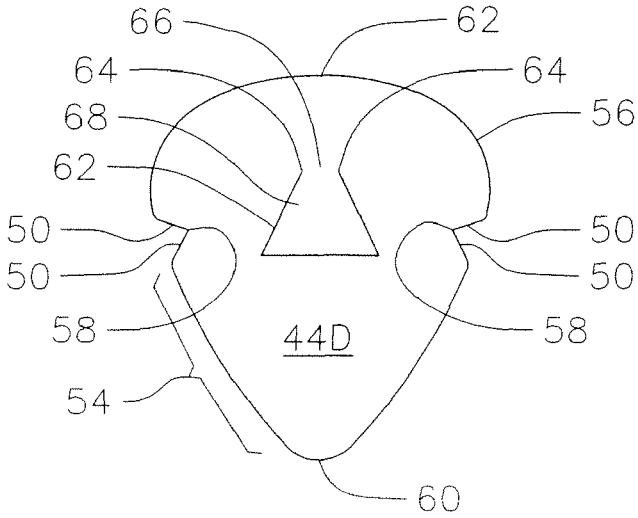
FIG. 6 is a top plan view of one removed pick from the card of FIG. 3.

FIG. 6 is a top plan view of the snapped off pick 44D. The removed pick 44D has as its outline the cut line sections 46 that defines its wider top 52 which extends down at its left and right sides to the upper ends of the turned in cut lines 50, and its lower half has left and right side 54 and a lower narrower end 60, which is generally used for contact with strings when plucking and picking. As can be seen, the inwardly turn ends 50 of the cut lines generally extend into the body of the pick 44D, and the areas where the webs 48 are broken 58 lie inwardly of the general outline of the side edges 54 of the pick. So, if there are any sharp edges or projections that might have resulted when picks were removed from the card body, they will lie inwardly of the general outward edges of the pick, and any such sharp edges or projects would not be in contact to cause discomfort with the user's fingers or create a projection which might inadvertently rasp on a musical instrument string. These inturned areas provide further grip areas with which to hold the piece. The result is a pick that is comfortable to hold and use and which is smooth at all possible contact surfaces.

The cut lines are be made to be relatively thin, so that even after a pick, e.g., 44D is removed from the card body 42, the pick 44D can be reinserted in the opening 52 with the tight fit of the pick 44D forming an interference fit with the opening, thereby allowing reinsertion of the pick and storage therein.

With respect to the card bodies of FIGS. 1, 2, 4, and 5, they can be conveniently sized to be the same or similar to charge cards, credit cards or business cards (e.g. from about 50.8 mm to 54 mm (2" to 2.125") by about 85.7 mm to 88.9 mm (3.375" to 3.5") so that it can be conveniently carried in a user's wallet or handbag along with other similar sized cards. Naturally, other sizes can be used. Also, as noted above, other sizes of card bodies can be provided.

If desired, the cut lines can be made to be relatively thin, so that even after a pick, e.g., 14D or 44D is removed from the card body 12 or 42, respectively, the pick 14D and 44D can be reinserted in the opening 22 or 52 with the tight fit of the pick 14D or 44D forming an interference fit with the opening, thereby allowing reinsertion of the pick and storage therein. With modern die cutting equipment, very thin die cut lines can be formed such that the cut line does not remove much, if any, material along the cut line. Accordingly, with use of the proper die cutting equipment, the object being die cut ("die cut object") from a section of material ("base material") may be snapped back into place and frictionally retained with an interference fit in the opening in the base material from which the die cut object was cut. In such cases, interruption(s) in the die cut line to form webs between the die cut object and the base material can be made to be very thin so that the dimensions and number of webs can be adjusted as desired to adjust the amount of force necessary to be applied to detach a die cut object from the base material. Also, depending on the thickness of the blade used and angle of the cutting edge of the blade, when die cutting the object from the base material, the perimeter edge of the pick may become somewhat rounded off and become very smooth.

Although a preferred embodiment of the present invention has been described, it should not be construed to limit the scope of the appended claims. For example, the present invention may be implemented to include a variety of different pick sizes, shapes, thicknesses and layouts.

In addition, those skilled in the art will understand that various modifications may be made to the described embodiment. Moreover, to those skilled in the various arts, the invention itself herein will suggest solutions to other tasks and adaptations for other applications. It is therefore desired that the present embodiments be considered in all respects as illustrative and not restrictive, reference being made to the appended claims rather than the foregoing description to indicate the scope of the invention.

What is claimed is:

1. A snap away musical instrument pick, comprising:

a sheet of material with at least one musical instrument pick outlined therein by at least one cut line with ends formed around a portion of the pick, wherein the ends of the at least one cut line turn inwardly into the musical instrument pick, and wherein the ends of the cut lines are spaced apart to form at least one uncut area therebetween that defines a web joining the at least one musical instrument pick to a card body outside of the at least one cut line, wherein the pick is detached from the card body by severing the at least one web without leaving any rough edges along outer edges of the musical instrument pick, and a grip cut line formed in the at least one musical instrument pick, the grip cut line following a contour with two closely spaced apart ends that lie away from outer edges of the cut line that defines the outline of the musical instrument pick so that the grip cut line provides a pivot for a grip section relative to the rest of the pick, the grip cut line enhancing the slip resistance of the pick when being held by a user without causing the musical instrument pick to become extremely flexible.

2. The snap away musical instrument pick of claim 1, wherein two cut lines are provided and two webs are formed joining the at least one musical instrument pick to the card body.

3. The snap away musical instrument pick of claim 1, wherein the at least one musical instrument pick is detachably attached to the rest of the sheet of material by an interference fit between the pick and the sheet of material along the at least one cut line, and by the at least one web, wherein the pick is detached from the card body by displacing the at least one pick from the card body to interrupt the interference fit and also by severing the at least one web, and wherein a perimeter edge is formed to allow the at least one pick to be reattached to the card body, and wherein the pick is formed such that the pick is brought back into contact in an interference fit with said perimeter edge of an aperture, said aperture is being formed when the pick is removed from the card body.

4. The snap away musical instrument pick of claim 1, wherein the sheet of flat material comprises generally rigid plastic sheet material.

5. The snap away musical instrument pick of claim 1, wherein the cut lines are foamed by die cutting.

6. The snap away musical instrument pick of claim 1, wherein the sheet of flat material is selected from the group consisting of plastic sheet material, shell, bone, metal and paper.

7. A snap away musical instrument pick, comprising:

a sheet of plastic material with a plurality of musical instrument picks, each musical instrument pick being outlined therein by two cut lines with ends formed around a portion of the pick, wherein the ends of the two cut lines turn inwardly into the musical instrument pick inwardly of a general outline shape of the picks, and wherein the ends of the two cut lines are spaced apart to form two uncut areas therebetween that defines webs joining the at least one musical instrument pick to a card body outside of the cut lines, wherein the picks are each detached from the card body by severing the two webs without leaving any rough edges along outer edges of the musical instrument pick, and a grip comprising a grip cut line formed in the at least one musical instrument pick, the grip cut line following a contour with two closely spaced apart ends that lie away from outer edges of the cut line that defines the outline of the musical instrument pick so that the grip cut line provides a pivot for a grip section relative to the rest of the pick, the grip cut line enhancing the slip resistance of the pick when being held by a user without causing the musical instrument pick to become extremely flexible.

8. The snap away musical instrument pick of claim 7, wherein the at least one musical instrument pick is detachably attached to the rest of the sheet of material by an interference fit between the pick and the sheet of material along the at least one cut line, and by the at least one web, wherein the pick is detached from the card body by displacing the at least one pick from the card body to interrupt the interference fit and also by severing the at least one web, and wherein a perimeter edge is formed to allow the at least one pick to be reattached to the card body, and wherein the pick is formed such that the pick is brought back into contact in an interference fit with said perimeter edge of an aperture, said aperture is being formed when the pick is removed from the card body.

* * * * *